US006543998B1

(12) United States Patent
Scharl

(10) Patent No.: US 6,543,998 B1
(45) Date of Patent: Apr. 8, 2003

(54) NOZZLE RING FOR AN AIRCRAFT ENGINE GAS TURBINE

(75) Inventor: Richard Scharl, Karlsfeld (DE)

(73) Assignee: MTU Motoren-und Turbinen-Union Muenchen, GmbH, Munich (DE)

( * ) Notice: Subject to any disclaimer, the term of this patent is extended or adjusted under 35 U.S.C. 154(b) by 0 days.

(21) Appl. No.: 09/645,483

(22) Filed: Aug. 25, 2000

(30) Foreign Application Priority Data

Aug. 30, 1999 (DE) ..... 199 41 133

(51) Int. Cl.[7] ..... F01D 1/02
(52) U.S. Cl. ..... 415/209.3; 415/191
(58) Field of Search ..... 415/209.2, 209.3, 415/209.4, 210.1, 191, 187, 189, 190

(56) References Cited

U.S. PATENT DOCUMENTS 2,681,788 A * 6/1954 Wosika ..... 415/136
4,260,327 A * 4/1981 Armor et al. ..... 415/189
4,704,066 A * 11/1987 Weissbacher ..... 415/191
5,474,419 A * 12/1995 Reluzco et al. ..... 415/209.4
5,779,443 A * 7/1998 Haller et al. ..... 415/191

FOREIGN PATENT DOCUMENTS

| | | |
|---|---|---|
| DE | 1200070 | 9/1965 |
| EP | 0199073 | 10/1986 |
| EP | 0704602 | 4/1996 |

OTHER PUBLICATIONS

Copy of German Office Action.

* cited by examiner

*Primary Examiner*—Edward K. Look
*Assistant Examiner*—Dwayne J. White
(74) *Attorney, Agent, or Firm*—Crowell & Moring LLP

(57) ABSTRACT

A nozzle ring for a gas turbine, more particularly for an aircraft engine, has at least one shroud with a circumferential surface and at least one blade with a surface. The shroud has at least one opening for fastening the blade. The blade has at least one end section with a platform which projects at least partially over its circumference and which has a transition curve and which is inserted into the opening.

11 Claims, 3 Drawing Sheets

NOZZLE RING FOR AN AIRCRAFT ENGINE GAS TURBINE

BACKGROUND AND SUMMARY OF THE INVENTION

This application claims the priority of German Patent Document 199 41 133.6, filed Aug. 30, 1999, the disclosure of which is expressly incorporated by reference herein.

The invention concerns a constructed nozzle ring for a gas turbine, more particularly for an aircraft engine, comprising a shroud with a circumferential surface and at least one blade with a surface, with the shroud having at least one opening for fastening the blade, the circumferential surface of the shroud facing the blade, and the blade having on at least one end section a platform which has at least in part a transition curve which projects above its surface and which is inserted in the opening.

Constructed nozzle rings are integral components which generally comprise a ring-shaped outer shroud, several blades, and in some cases a ring-shaped inner shroud. Nozzle rings of this kind can also be constructed in segments and are used by way of example in condensers of aircraft engines. The shroud generally extends around the longitudinal axis of the gas turbine. The blades are essentially arranged in radial direction.

In a known constructed nozzle ring, the blade has at least one end section with a constant profile or a constant cross-sectional area which is inserted in an opening formed in the shroud during assembly and is fastened through soldering or welding for example. The blade can also have a constant profile or a constant cross section at an opposite, second end section and be inserted in a second shroud, i.e., an exterior and interior shroud. A drawback to this is that while the profile of the blade does not have to be constant over the entire channel height, it is nevertheless restricted with respect to its profile geometry for assembly reasons. The blade for example cannot have a sharp bend or pronounced increase in thickness in the area situated between the end sections. In addition, the openings in the area of the inlet and outlet edges may be very slim in the case of narrow shovel geometry, which creates problems in manufacture.

Known from German Patent Document DE-AS 12 00 070 is a manufacturing method for a vane ring in which the footings of the blades are inserted in grooves formed in a ring body, whereby the blade transitions with a curve into the blade footing and the ring body is separated at the end into several segments.

European Patent Document EP 0 704 602 A2 discloses turbine blades arranged on a carrier in which the surface of the blade transitions radially into the circumferential surface of the carrier.

Furthermore a manufacturing method for a vane is known from European Patent Document EP 0 199 073 A1 which is fastened to a stator through soldering, whereby the vane is manufactured from an oversized profile bar and whereby a foot-like thickening is upset into the profile bar at at least one end in order to increase the soldering surface and in this area a soldering surface is formed. For the incidence of the vanes, the profile bar can be upset diagonally on one side.

An object of the present invention is to create a constructed nozzle ring of the type described above which provides savings in the overall axial length, can be manufactured as simply as possible, and is subjected to no or only slight restrictions with respect to profile geometry of the blade, for example for installation reasons.

The solution of the object according to the invention is characterized in that the platform in the area of an inlet and/or outlet edge of the blade projects over the surface of the blade less than in the middle area of the blade and thus overall axial size is reduced.

The circumference of the platform can be adapted to a circumference of the blade which is situated radially in an area opposite the tip of the blade so that the distance between said two circumferences is essentially constant except in the area of the inlet and/or outlet edge.

The transition curve can be configured increasingly narrower from a middle area of the blade in the direction of the inlet and/or outlet edge. Alternatively, the blade in the area of the inlet and/or outlet edge can have no platform projecting above its surface.

The advantage of such a constructed nozzle ring is that as a result of the additionally provided platform, the coupling of blade and shroud is possible without restriction with respect to the profile geometry of the blade. In addition, the platform, which is provided with a transition curve, provides advantages with respect to aerodynamics and strength. The openings in the shroud have larger radii in the area of the inlet and outlet edge and are easier to fabricate.

In one configuration, the transition curve conforms to the surface of the blade and to the circumferential surface of the shroud which borders the platform in assembled condition for optimal shape with respect to aerodynamics and strength.

In addition, the blade in the area of the inlet and/or outlet edge can have no platform over the circumference of such edge as a result of which the overall axial length of the nozzle ring is further reduced. Since the platform in addition with its circumference runs out in the inlet and/or outlet edge on both sides, the problem of the too narrower or difficult to manufacture edges in the openings of the shroud does not occur.

In the case of no platform, the surface of the blade in the area of the inlet and/or outlet edge in assembled condition can border the circumferential surface of the shroud, whereby in the remaining area along the circumference of the blade, for example in the middle area on the suction and pressure sides, there is a platform with a transition curve projecting above the circumference of the blade.

The transition curve can alternatively be configured increasingly narrow from a middle area of the blade, for example on the suction and pressure side, in the direction toward the inlet and/or outlet edge so that as a result of the narrower curve in the area of the inlet and/or outlet edge overall axial length is reduced.

The transition curve can be configured in a circular shape at least in part and have a radius whereby in the middle area of the blade it is larger than in the other areas along the circumference of the blade. If the blade has a platform along the entire circumference which projects above its circumference, the radius is thus smallest in the area of the inlet and/or outlet edge in order to reduce the overall axial length.

In a constructed nozzle ring, the radius along the circumference of the blade can be constant and its middle point can be modified such that the transition curve conforms along the entire circumference to the surface of the blade and there is a tangential jump to the circumferential surface of the shroud at the inlet and/or outlet edge. Manufacture with constant radius is favorable. In addition, as a result of the tangential jump at the inlet and/or outlet edge, which to that point can increase successively, the overall axial length of the nozzle ring is reduced.

Additional preferred exemplary embodiments of the invention are described in the subclaims.

Other objects, advantages and novel features of the present invention will become apparent from the following detailed description of the invention when considered in conjunction with the accompanying drawings.

DETAILED DESCRIPTION OF THE DRAWINGS

Figure 1:
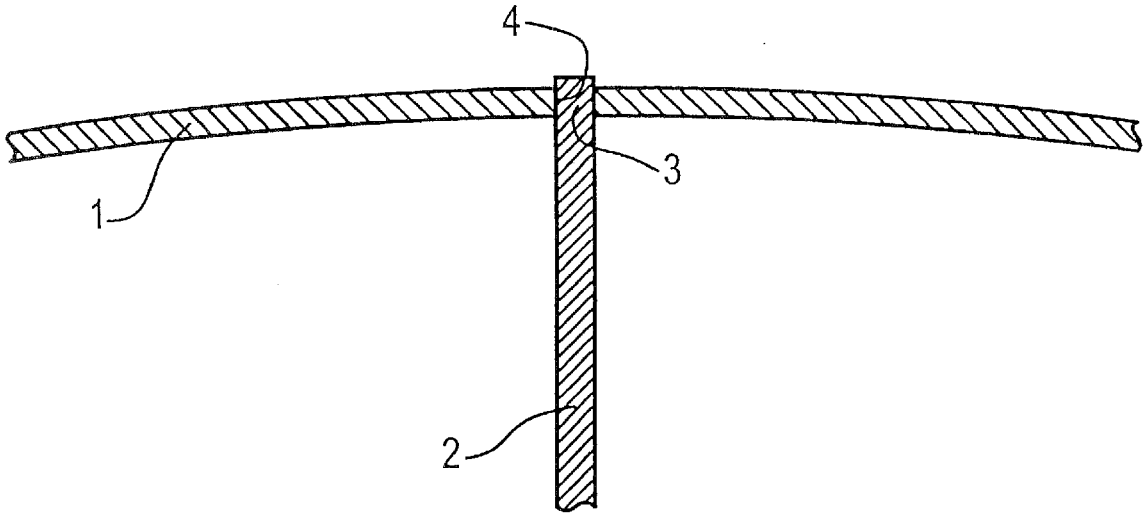
Fig. 1 PRIOR ART
FIG. 1 shows a section view through a blade and a shroud according to the state of the art.

FIG. 1 shows a section of a nozzle ring known from the state of the art with an outer shroud 1 and a blade 2, which has an end section 3. Several openings 4 are formed in outer shroud 1, generally in equidistant arrangement. In each opening 4, the end section 3 of a blade 2 is inserted and is fastened there, for example through soldering or welding. In order to make assembly possible, the end sections 3 of blades 2 have a two-dimensional and/or constant profile. Even if blades 2 do not necessarily have to have a constant profile across the entire channel height, its profile geometry for assembly reasons is subject to pronounced restrictions. Blades 2 may not have a sharp bend or pronounced thickenings. In addition, configuring the openings 4 which have relatively narrow profiles in shroud 1 is problematical.

Figure 2:
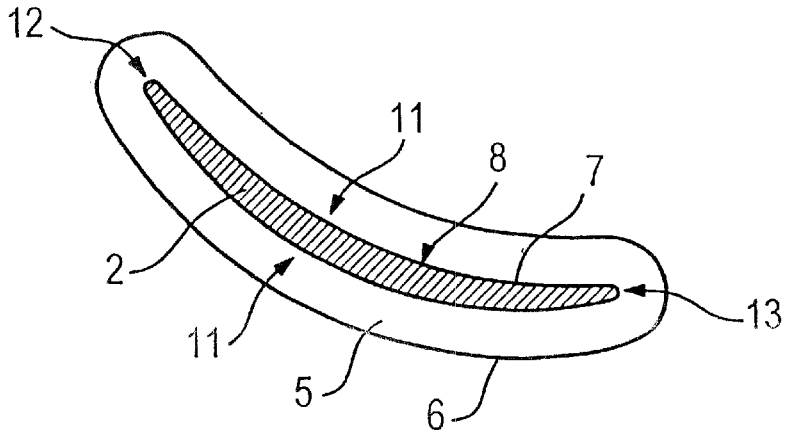
FIG. 2 shows a top view of a cut blade including platform according to an exemplary embodiment of the constructed nozzle ring according to the invention.

FIG. 2 shows a top view of an exemplary embodiment of the constructed nozzle ring in which blade 2 is depicted in cross section and a platform 5 which joins the free end of blade 2 are depicted. In this case, the profile or the shape of the opening 4 in shroud 1 corresponds to the profile or circumference 6 of platform 5 and is larger than the circumference 7 of blade 2. Surface 8 of blade 2 transitions with a transition curve 9 into platform 6 which is configured such that in assembled condition it conforms both to surface 8 of blade 2 as well as to inner circumferential surface 10 of shroud 1.

Figure 7:
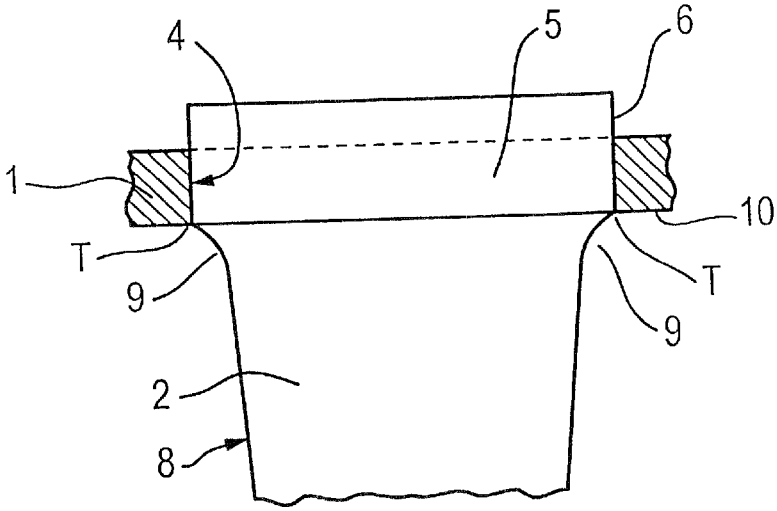
FIG. 7 shows a further section view of the exemplary embodiment according to FIG. 5.

Transition curve 9 is configured as a radius which is larger in the middle area 11 of blade 2 than in the area of the inlet edge and outlet edge 12, 13 and to that point can by way of example become successively smaller. Alternatively transition curve 9 can have a constant radius along the circumference whereby in this case its middle point to inlet and outlet edge 12, 13 is changed such that circumferential curve 9 has a constant radius along the circumference whereby in this case its middle point is modified toward inlet and outlet edge 12, 13 such that circumferential curve 9 also conforms to surface 8 of blade 2 at that point and, as depicted in FIG. 7, has a tolerable tangential jump toward inner circumferential surface 10 of shroud 1. This alternative has manufacturing advantages.

Figure 3:
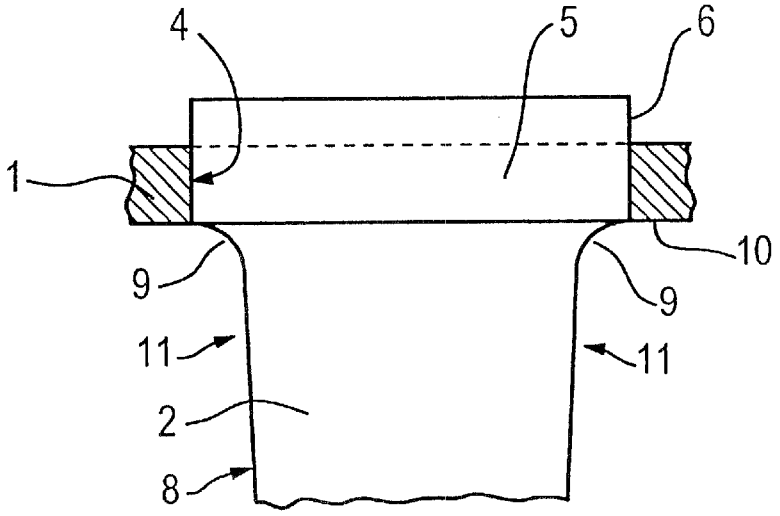
FIG. 3 shows a section view of the exemplary embodiment from FIG. 2.

FIG. 3 shows a section view of shroud 1 and blade 2 in which the radius of transition curve 9 is depicted in the middle area 11 of blade 2. Shovel blade 2 is inserted with platform 5 into a opening 4 in shroud 1 whereby the profile and/or form of opening 4 conforms to the profile or circumference 6 of platform 5. The circumference 6 of platform 5 in this area 11 projects well over surface 8 of blade 2.

Figure 4:
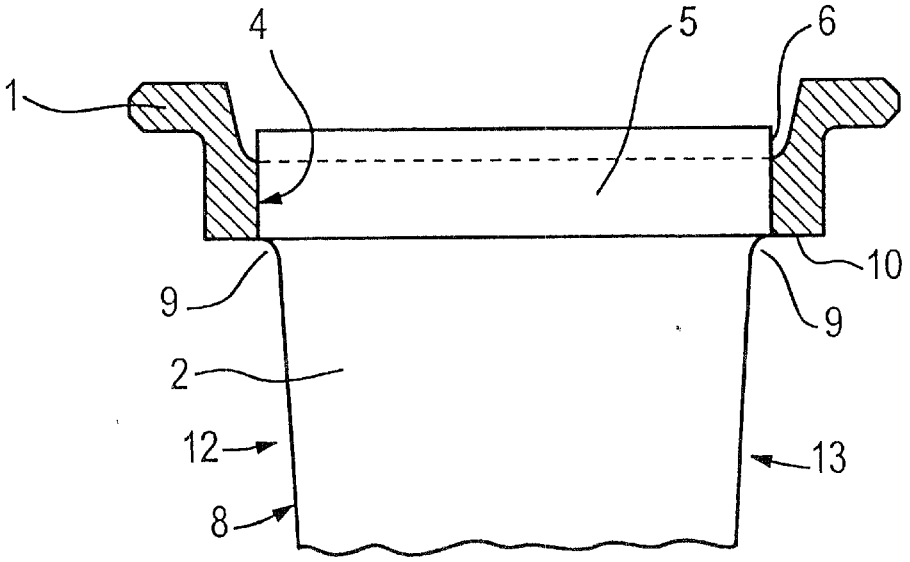
FIG. 4 shows a further section view of the exemplary embodiment from FIG. 2.

In FIG. 4, a section in the area of the inlet and outlet edge 12, 13 of blade 2 is depicted. Platform 5 of blade 2 is inserted and fastened in opening 4 which is formed in shroud 1. Platform 5 has a radius as transition curve 9 which is clearly smaller than that in the middle area 11, depicted in FIG. 3, so that circumference 6 of platform 5 projects clearly less over surface 8 of blade 2. The radius and/or transition curve 9 conforms first to surface 8 of blade 2 and second to circumferential surface 10, which is turned toward the interior, of shroud 1. As a result of the clear reduction of size of transition radius 9 in the area of inlet and outlet edge 12, 13, the overall axial length of the constructed nozzle ring is effectively reduced. At the same time, openings 4 in shroud 1 as a result of the lack of sharp edges or the like can be manufactured efficiently since the circumference 6 of platform 5 has a larger surface than that of blade 2.

Alternatively the reduction of overall axial length in the exemplary embodiment according to FIG. 4 can also be obtained in a manner which is advantageous with respect to manufacturing technology by means of a transition curve 9 with a constant radius along the circumference if its middle point changes as described above toward the inlet and/or outlet edge 12, 13 and there a tangential jump T is permitted in the transition to shroud 1.

In the case of a constant radius to inlet and/or outlet edge 12, 13, tangential jump T can increase successively.

Figure 5:
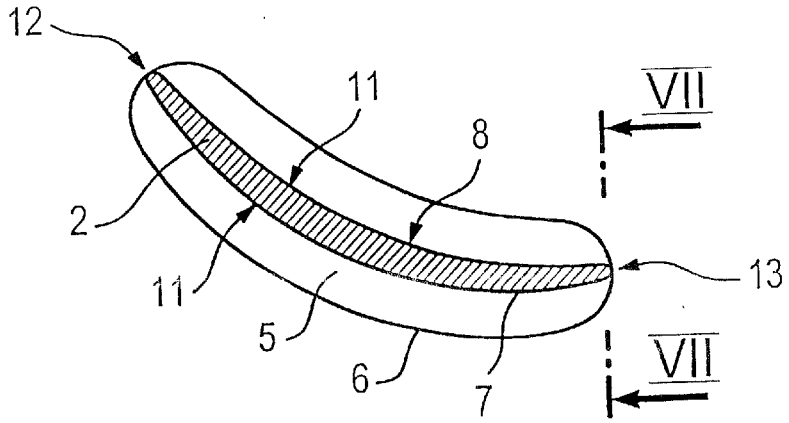
FIG. 5 shows a top view of a sectioned blade including platform according to another exemplary embodiment of the constructed nozzle ring according to the invention.

FIG. 5 shows a further exemplary embodiment of the constructed nozzle ring in which a sectioned blade 2 and a platform 5 are depicted in top view. Circumference 6 of platform 5 projects in the middle area 11 of blade 2 or at the pressure and suction side over surface 8 of blade 2 and at this point has a transition curve 9. Platform 5 terminates directly bordering inlet edge 12 and outlet edge 13 and in these two areas does not project over the profile or circumference 7 of blade 2. Transition curve 9, which terminates on the two sides of inlet and/or outlet edge 12, 13 is configured such that in the circumferential direction it conforms to surface 8 or runs out there directly at the inlet and outlet edge 12, 13. In this manner, the axial dimensions of the constructed nozzle ring can be effectively reduced without narrow openings 4 with sharp edges having to be produced in shrouds 1.

While in the exemplary embodiment in FIGS. 2 through 4 there is a transition curve 9 with clearly smaller radius (or with the same radius and altered middle point and tangential jump at the inlet and outlet edge 12, 13 than on the suction and pressure side, the exemplary embodiment from FIG. 5 is configured in the area of inlet and outlet edge 12, 13 without transition curve 9 so that surface 8 of blade 2 in assembled condition borders directly on inner circumferential surface 10 of shroud 1.

Figure 6:
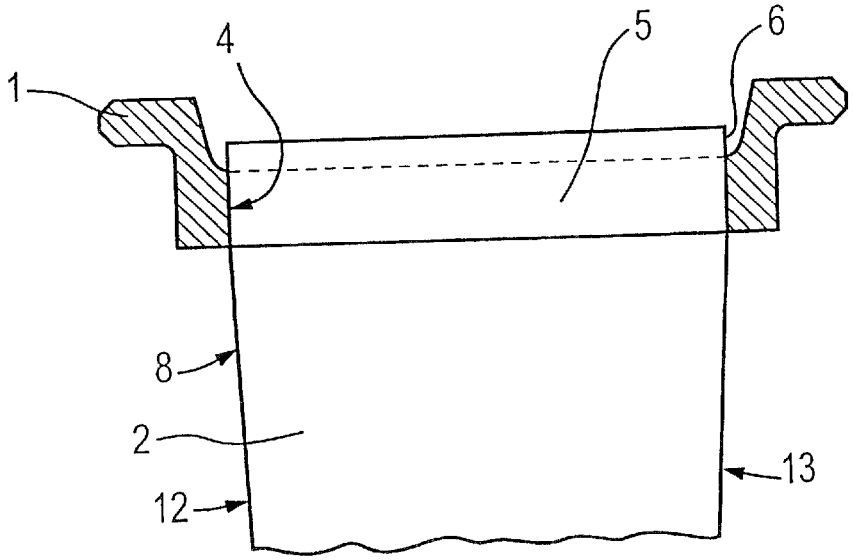
FIG. 6 shows a section view of the exemplary embodiment according to FIG. 5.

FIG. 6 shows the exemplary embodiment from FIG. 5 in a section view in which shroud 1, blade 2, and platform 5 are depicted directly in the area of inlet and outlet edge 12, 13. In this configuration, blade 2 does not have a transition curve 9 at the transition to platform 5, as a result of which the overall axial length is effectively reduced. Circumference 6 of platform 5 in this area essentially does not project over surface 8 of blade 2 or its circumference 7.

FIG. 7 shows the exemplary embodiment from FIG. 5 in a section shown in FIG. 5 bordering on inlet and outlet edge 12, 13 of blade 2. Transition curve 9 has the same radius as in the middle area 11 of blade 2. The depiction of transition curve 9 in middle area 11 of blade corresponds in this exemplary embodiment to that of the exemplary embodiment according to FIG. 2 and is shown in FIG. 3.

Because of the constant radius, which is advantageous with respect to manufacturing technology, with simultaneous shifting of its middle point such that transition curve 9 conforms along the entire circumference 7 to surface 8 of blade 2 and is present up to bordering on inlet and/or outlet edge 12, 13 an increasing tangential jump T to inner surface 10 of shroud 1, the axial length of the nozzle ring is reduced.

The measures described by way of example at an outer shroud can be realized in corresponding manner on an additional inner shroud.

What is claimed is:

1. Constructed gas turbine nozzle ring, comprising a shroud with a circumferential shroud surface extending around a gas turbine axis and at least one blade with a surface, whereby the shroud has at least one opening for fastening the blade, and whereby the blade has a platform at at least one end section which projects at least in part beyond the surface and which has a transition curve, the platform being inserted into the opening, wherein the platform in an area of an inlet or outlet edge of the blade projects beyond the surface of the blade less than in a middle area of the blade in order to decrease an axial length of the opening.

2. Constructed nozzle ring comprising a shroud with a circumferential shroud surface extending around a gas turbine axis and at least one blade with a surface, whereby the shroud has at least one opening for fastening the blade, and whereby the blade has a platform at at least one end section which projects at least in part beyond the surface and which has a transition curve, the platform being inserted into the opening, wherein the platform in an area of an inlet or outlet edge of the blade projects beyond the surface of the blade less than in a middle area of the blade in order to decrease an axial length of the opening, wherein the transition curve at the blade surface is configured with a larger radius of curvature in the middle are of the blade than at the inlet or outlet edge.

3. Constructed nozzle ring according to claim 2, wherein the platform in the middle area on a suction or pressure side of the blade projects beyond the surface of the blade.

4. Constructed nozzle ring according to claim 2, wherein the transition curve conforms to the surface of the blade and to a bordering circumferential surface of the shroud.

5. Constructed nozzle ring according to claim 2, wherein the surface of the blade in the area of the inlet or outlet edge borders a circumferential surface of the shroud.

6. Constructed nozzle ring according to claim 2, wherein the circumference of the platform is conformed to a circumference of the blade.

7. Constructed nozzle ring according to claim 6, wherein the platform in the middle area on a suction or pressure side of the blade projects beyond the surface of the blade.

8. Constructed nozzle ring according to claim 2, wherein the transition curve is configured at least partially as a radius.

9. Constructed nozzle ring according to claim 8, wherein the radius is larger in the middle area of the blade than in other areas along the circumference of the blade.

10. Constructed nozzle ring according to claim 9, wherein the radius along the circumference of the blade is constant and a middle point is modified such that the transition curve along the circumference conforms to the surface of the blade, and wherein a tangential jump to a circumferential surface of the shroud at the inlet or outlet edge is provided.

11. Constructed nozzle ring comprising a shroud with a circumferential shroud surface extending around a gas turbine axis and at least one blade with a surface, whereby the shroud has at least one opening for fastening the blade, and whereby the blade has a platform at at least one end section which projects at least in part beyond the surface and which has a transition curve, the platform being inserted into the opening, wherein the platform in an area of an inlet or outlet edge of the blade projects beyond the surface of the blade less than in a middle area of the blade in order to decrease an axial length of the opening, wherein the blade in the area of the inlet or outlet edge does not have a platform projecting beyond the surface.

* * * * *